US005267258A

United States Patent [19]

Omori et al.

[11] Patent Number: 5,267,258

[45] Date of Patent: Nov. 30, 1993

[54] FAST MELTING INDUCTION FURNACE WITH PRESSING COVER

[75] Inventors: Tsuguharu Omori; Michio Kawasaki, both of Kanagawa, Japan

[73] Assignee: Fuji Electric Co., Ltd., Kanagawa, Japan

[21] Appl. No.: 946,839

[22] Filed: Sep. 18, 1992

[30] Foreign Application Priority Data

Sep. 20, 1991 [JP] Japan ..... 3-240056

[51] Int. Cl.[5] ..... F27D 7/06

[52] U.S. Cl. ..... 373/140; 373/146; 373/156; 373/138; 75/10.14

[58] Field of Search ..... 373/151, 152, 155, 156, 373/138-140, 141, 146, 142, 153, 4; 75/226

[56] References Cited

U.S. PATENT DOCUMENTS

| | | | |
|---|---|---|---|
| 3,413,401 | 11/1968 | Dillon et al. | 373/4 |
| 3,656,946 | 4/1972 | Inque et al. | 75/226 |
| 3,811,001 | 5/1974 | Lethen | 373/153 |
| 4,486,889 | 12/1984 | Hegewaldt et al. | 373/142 |
| 4,773,079 | 9/1988 | Bruckmann et al. | 373/141 |
| 5,109,389 | 4/1992 | Stenzel | 373/156 |

FOREIGN PATENT DOCUMENTS

| | | |
|---|---|---|
| 55-118581(A) | 9/1980 | Japan . |
| 61-168779(A) | 7/1986 | Japan . |

*Primary Examiner*—Bruce A. Reynolds
*Assistant Examiner*—Tu Hoang
*Attorney, Agent, or Firm*—Finnegan, Henderson, Farabow, Garrett & Dunner

[57] ABSTRACT

In a fast-melting induction furnace, an elevationally movable pressing cover 4 suppresses the swell of molten metal 3 inside a crucible 2 on which a coil 1 is wound. The pressing cover 4 has a lower surface which is made concave. An upper half part of the motion of the molten metal 3 caused by electromagnetic force is made in conformity with the concave shape of the lower surface 5, so that the dangerous blowout of molten metal through a gap 8 is effectively prevented. Accordingly, the fast melting by the supply of high electric power can be performed. The lower surface 5 may be shaped as a cylindrical surface, a paraboloidal surface of revolution, a partial spherical surface, or the like, or may be shaped like a runner bucket of a Pelton turbine which has a slightly projecting center portion.

3 Claims, 1 Drawing Sheet

FAST MELTING INDUCTION FURNACE WITH PRESSING COVER

BACKGROUND OF THE INVENTION

The present invention relates to a fast melting induction furnace which is provided with a pressing cover and which is operated at a high-frequency to fast-melt a cold material.

Japanese Patent Unexamined Publication Nos. Sho-55-118581 and Sho-61-168779 are known as conventional art literatures relating to a fast melting induction furnace provided with a pressing cover. In the literatures, the lower surface of the pressing cover is made plane. In a fast melting induction furnace, generally, if electric power is supplied at a high frequency to fast-melt a cold material, the material swells at its center portion. Therefore, the electric power cannot be supplied sufficiently in the devices disclosed in such publications. Also, such swell-of the material increases the surface area of molten metal so that both oxidation and gas absorption increase. In view of the above-noted difficulty, an up/down movable pressing cover is arranged in the inside of a crucible in order to suppress the swell of the molten metal and exclude the outside air.

FIG. 2 is a sectional view of such a conventional art. The swell of molten metal 3 in the inside of a crucible 2 on which coils 1 is wound is suppressed by a pressing cover 24 having a lower surface made plane. In order to elevationally move the pressing cover 24 within the inside of the crucible 2, a gap is inevitable formed between the pressing cover 24 and the crucible 2. As is well-known, the molten metal 3 makes a motion under electromagnetic force as expressed by the arrows in the drawing. This causes the swelling of molten metal. Because of the motion of molten metal and the existence of such a gap, there occurs blow-out 23 of molten metal 3 through the gap. The blow-out 23 is so dangerous that the supply of high electric power is prohibited to make fast-melting impossible.

SUMMARY OF THE INVENTION

An object of the present invention is to provide a fast melting induction furnace with a pressing cover by which the blowout of molten metal through a gap between a pressing cover and a crucible is prevented to make it possible to perform fast-melting by the supply of high electric power.

According to the present invention, in the fast melting induction furnace provided with an elevationally movable pressing cover arranged inside a crucible on which coils are wound, the lower surface of -the pressing cover is made concave. In this case, a sensor hole may be formed through the pressing cover so that a temperature sensor can be passed through the hole.

DESCRIPTION OF THE PREFERRED EMBODIMENT

Figure 1:
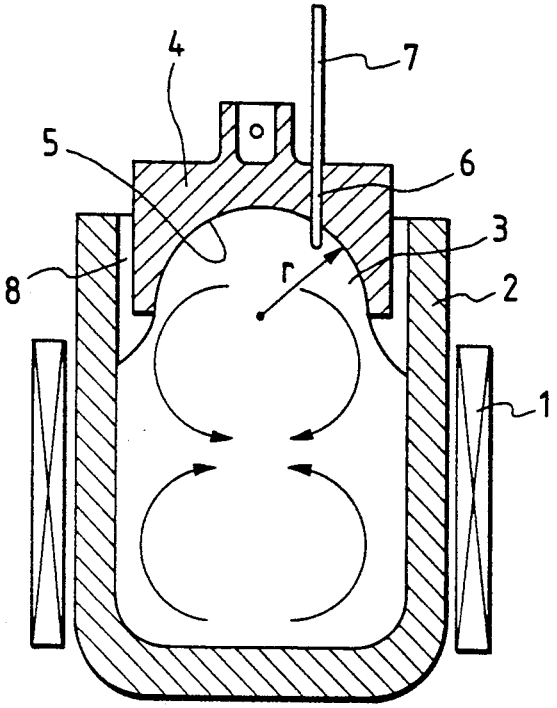
FIG. 1 is a sectional view showing an embodiment of the present invention.
Figure 2:
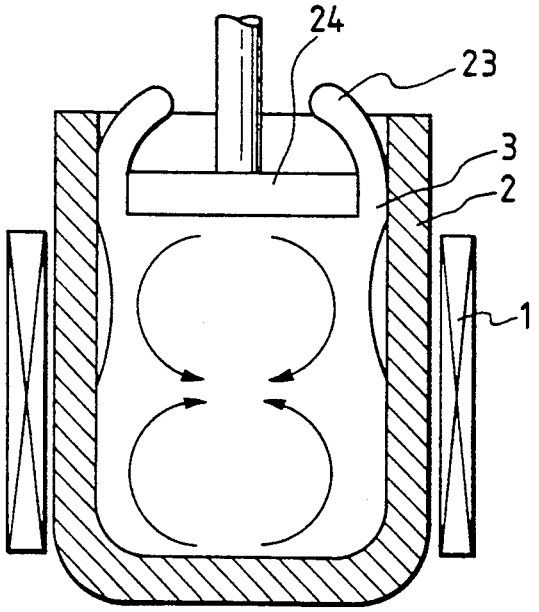
FIG. 2 PRIOR ART
FIG. 2 is a sectional view showing a conventional example.

FIG. 1 is a sectional view showing an embodiment of the present invention. An elevationally movable pressing cover 4 suppresses the swell of molten metal 3 inside a crucible 2 on which a coil 1 is wound. As a feature of this embodiment, the pressing cover 4 has a lower surface 5 made concave. Further, a sensor hole 6 is formed through the pressing cover 4 so that a temperature sensor 7 for measuring the temperature of the molten metal 3 can be passed through the sensor hole 6. Under electromagnetic force of the coils 1, the molten metal 3 makes a motion as expressed by the arrows in the drawing. An upper half part of the motion of the molten metal 3 is made in conformity with the concave shape of the lower surface 5, so that the blowout of molten metal 3 through a gap 8 can be prevented. Accordingly, fast-melting by the supply of high electric power can be performed. The lower surface 5 may be shaped as a combination of a hemispherical surface having a radius of r with its center at a slightly upper point than the lower end of the pressing cover 4 and a cylindrical or truncated cone surface continue-d to the lower end of the hemispherical surface, or may be shaped as various concaves such as a paraboloidal surface of revolution, a partial spherical surface, or the like. Alternatively, the lower surface 5 may be shaped like a runner bucket of a Pelton turbine which has a slightly projecting center portion to be fitted to the motion of molten metal.

In addition, both the process and termination of melting can be detected through the temperature sensor 7 inserted through the sensor hole.

According to the present invention, in a fast melting induction furnace having an elevationally movable pressing cover arranged inside a crucible on which a coil is wound, the lower surface of the pressing cover is made concave. Owing to such configuration, the motion of molten metal can be made in conformity with the concave shape of the lower surface of the pressing cover, so that the blowout of molten metal through a gap can be prevented. There arises an effect in that fast melting by the supply of high electric power can be performed. If a temperature sensor is inserted through a sensor hole, there arises also another effect in that both the progress and termination of melting can be detected.

What is claimed is:

1. A fast melting induction furnace, comprising:

a crucible;

a coil wound outside said crucible; and an elevationally movable pressing cover arranged inside said crucible, and wherein:

said pressing cover has a concave lower surface which is in conformity with a motion of a molten steel in said crucible.

2. The fast melting induction furnace according to claim 1, wherein, a sensor hole is formed through said pressing cover whereby a temperature sensor is passed through said hole.

3. The fast melting induction furnance according to claim 1, wherein said concave lower surface is shaped as a combination of a hemispherical surface with its center at a slightly upper point than a lower end of the pressing cover and a cylindrical surface continued to the lower end of said hemispherical surface.

* * * * *

UNITED STATES PATENT AND TRADEMARK OFFICE

CERTIFICATE OF CORRECTION

PATENT NO. : 5,267,258

DATED : November 30, 1993

INVENTOR(S) : Tsuguharu Omori et al.

It is certified that error appears in the above-indentified patent and that said Letters Patent is hereby corrected as shown below:

Claim 2, column 2, line 57, after "wherein" delete --,--.

Claim 3, column 2, line 60, change "furnance" to --furnace--.

Signed and Sealed this

Sixth Day of September, 1994

Bruce Lehman

*Attest:*

BRUCE LEHMAN

*Attesting Officer*

*Commissioner of Patents and Trademarks*